US005803767A

United States Patent [19]

Matsumoto et al.

[11] Patent Number: 5,803,767

[45] Date of Patent: Sep. 8, 1998

[54] INSULATING STRUCTURE FOR A COAXIAL CONNECTOR

[75] Inventors: Mitsuhiro Matsumoto; Hidehiko Kuboshima, both of Shizuoka, Japan

[73] Assignee: Yazaki Corporation, Tokyo, Japan

[21] Appl. No.: 975,188

[22] Filed: Nov. 20, 1997

Related U.S. Application Data

[63] Continuation of Ser. No. 621,056, Mar. 22, 1996, abandoned.

[30] Foreign Application Priority Data

Mar. 23, 1995 [JP] Japan ..... 7-064404

[51] Int. Cl.[6] ..... H01R 13/40

[52] U.S. Cl. ..... 439/587; 439/585

[58] Field of Search ..... 439/587, 589, 439/584, 585

[56] References Cited

U.S. PATENT DOCUMENTS

| | | | |
|---|---|---|---|
| 2,736,871 | 2/1956 | Bales | 439/581 |
| 3,170,748 | 2/1965 | Van Horssen | 439/584 |
| 3,284,755 | 11/1966 | Mummey et al. | 439/581 |
| 4,331,374 | 5/1982 | Phillips | 439/584 |
| 4,761,146 | 8/1988 | Sohoel | 439/584 |
| 5,127,843 | 7/1992 | Henry et al. | 439/320 |
| 5,352,126 | 10/1994 | Kuboshima et al. | 439/587 |

FOREIGN PATENT DOCUMENTS

| | | |
|---|---|---|
| 3-182071 | 8/1991 | Japan . |
| 7-245153 | 9/1995 | Japan . |

*Primary Examiner*—Neil Abrams
*Assistant Examiner*—T. C. Patel
*Attorney, Agent, or Firm*—Sughrue, Mion, Zinn, Macpeak & Seas, PLLC

[57] ABSTRACT

To ensure insulation without increasing an insulating distance nor involving a molding process as well as to achieve the downsizing and easy production of an insulating structure, an insulating structure is provided for a shielded connector characterized in that a terminal is pressured onto conductors of an insulated core wire, so that the terminal is inserted within a terminal accommodating chamber; and that a shielding braid covering the insulated core wire is connected to a metallic shell inserted within and covering the terminal accommodating chamber. An annular insulator is fitted over the outer circumference of the insulated core wire between the terminal and the shielding braid. It is preferred that the insulator be made of an elastic material, and not only have the inner circumference thereof brought into intimate contact with the outer circumference of the insulated core wire, but also have the outer circumference thereof brought into intimate contact with the inner circumference of the terminal accommodating chamber.

5 Claims, 2 Drawing Sheets

INSULATING STRUCTURE FOR A COAXIAL CONNECTOR

This is a continuation of application No. 08/621,056, filed Mar. 22, 1996, now abandoned.

BACKGROUND OF THE INVENTION

The invention relates to an insulating structure for noise-preventing shielded connectors, and to an insulating structure for improving insulation between a terminal and a metallic shell covering the connector.

A shielded connector prevents electromagnetic radiation interference by putting an electrically conductive cover (hereinafter referred to as the "metallic shell") over inner conductors to shield a terminal connected to the inner conductors from external electric fields. This metallic shell is electrically connected to the shielding braid of a shielded wire. The shielded wire is prepared by covering with the shielding braid an insulated core wire whose outer circumference is sheathed with an inner insulator, and further covering the outer circumference of the shielding braid with an outer sheath concentrically. The shielding braid is connected to the metallic shell with part of the outer sheath cut and therefore with the corresponding part of the shielding braid exposed. On the other hand, the terminal is pressured and connected to the conductors of the insulated core wire led out of the inner circumference of the shielding braid. Therefore, the metallic shell connected to the shielding braid and the terminal are more or less close to each other, which thus raises the problem of insulation.

In order to improve insulation between the metallic shell and the terminal, the following structure shown, e.g., in FIG. 2 has heretofore been employed. The distance L between an exposed shielding braid 1 and conductors 4 of an insulated core wire 3 is set to a large value, so that the shielding braid 1 and a metallic shell 5 are insulated from a terminal 6 through distance.

Furthermore, another insulating structure that attempts to improve insulation without recourse to distance is disclosed in, e.g., Unexamined Japanese Patent Publication No. Hei. 3-182071. This insulating structure is designed to use a filling member. As shown in FIG. 3, this conventional example is characterized as sheathing not only conductors 11 of an insulated core wire 9 to which a terminal 7 has been connected but also a shielding braid 13 with a heat-resistant rubber member 15 by either press molding or injection molding. Therefore, both members 11 and 13 are sealed with a molded body 17 to insulate the conductors 11 from the shielding braid 13 and improve insulation therebetween.

However, when the distance L between the metallic shell 5 and the terminal 3 is increased in order to improve insulation, the total length of the connector housing is increased, thereby imposing the problem of increasing the size of the connector. Further, when the molded body 17 is prepared using a filling member to improve insulation between the conductors 11 and the shielding braid 13, the distance between the shielding braid 13 and the terminal can advantageously be reduced with the former insulated from the latter through the filling member, but such insulating structure disadvantageously requires the press molding or the injection molding process, thereby complicating the manufacturing process to decrease productivity and increase the cost of manufacture.

SUMMARY OF THE INVENTION

The invention has been made in view of the aforementioned circumstances. The object of the invention is, therefore, to provide an insulating structure for a shielded connector capable of ensuring insulation without having to increase the insulating distance nor using any filling member so that insulation, downsizing, and easy production can be achieved.

To achieve the above object, the invention is applied to an insulating structure for a shielded connector having a terminal connected to a conductor of an insulated core wire, and further having the terminal attached to a terminal accommodating chamber of a housing and having a shielding braid covering the insulated core wire connected to a metallic shell covering the terminal accommodating chamber. In such insulating structure for a shielded connector, an annular insulator is fitted over an outer circumference of the insulated core wire between the terminal and the shielding braid.

An insulator is interposed between a terminal and a shielding braid, so that the terminal and the shielding braid are insulated from each other through the insulator, not through distance. Therefore, insulation between both members can be ensured with a small distance. Further, the insulator can be interposed between both members only by fitting the insulator over the outer circumference of an insulated core wire, which thus will not complicate the process for preparing the insulating structure.

The insulator has a width in an axial direction, which is smaller than an axial length of the insulated core wire from which the shielding braid is folded back.

The annular insulator may be an O-ring.

| | |
|---|---|
| 25 | terminal accommodating chamber |
| 27 | inner housing (housing) |
| 31 | metallic shell |
| 39 | insulated core wire |
| 39a | conductors |
| 41 | male terminal (terminal) |
| 47 | braid (shielding braid) |
| 53 | insulator |

DESCRIPTION OF THE PREFERRED EMBODIMENTS

The present invention will now be described with reference to the accompanying drawings.

An insulating structure for a shielded connector, which is a preferred embodiment of the invention, will now be described with reference to the drawings.

Figure 1:
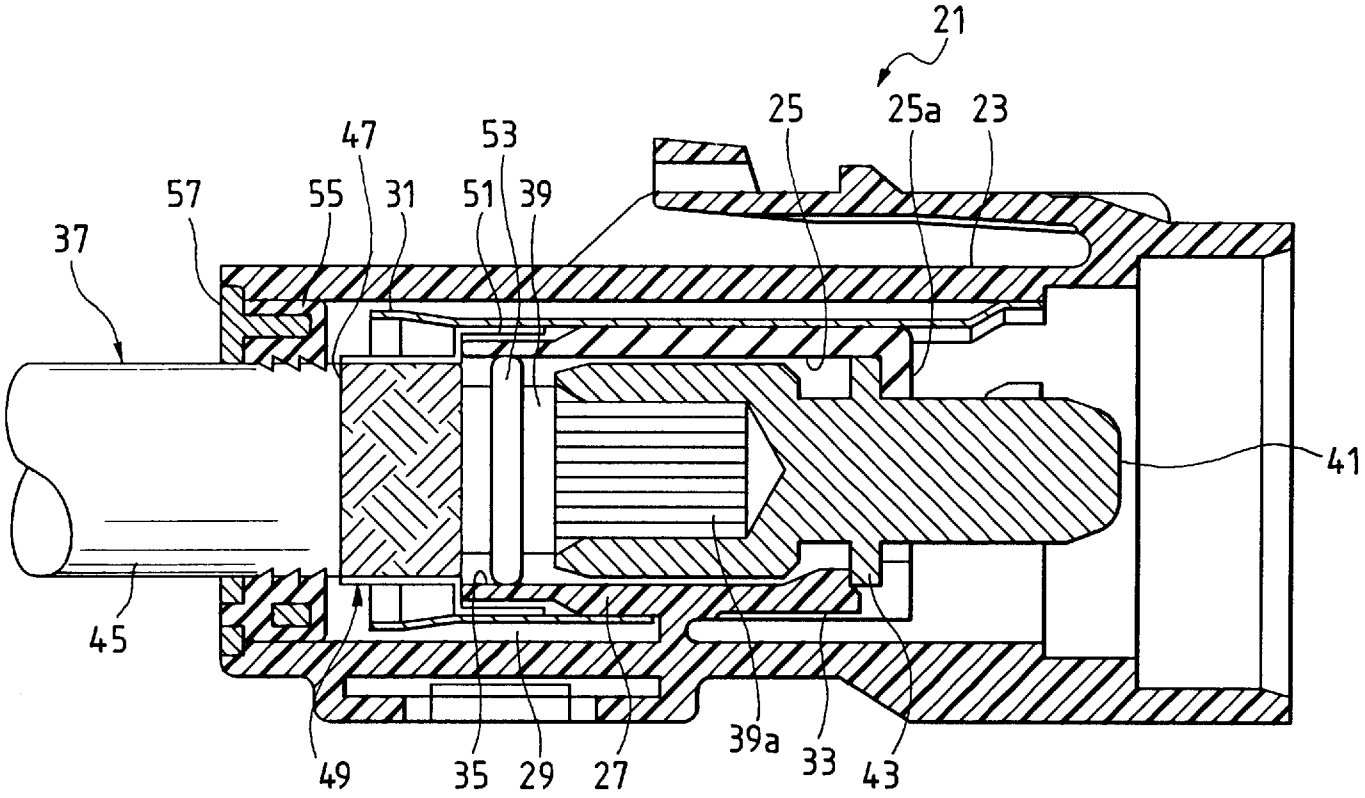
FIG. 1 is a sectional view showing an insulating structure for a shielded connector of the invention.
Figure 2:
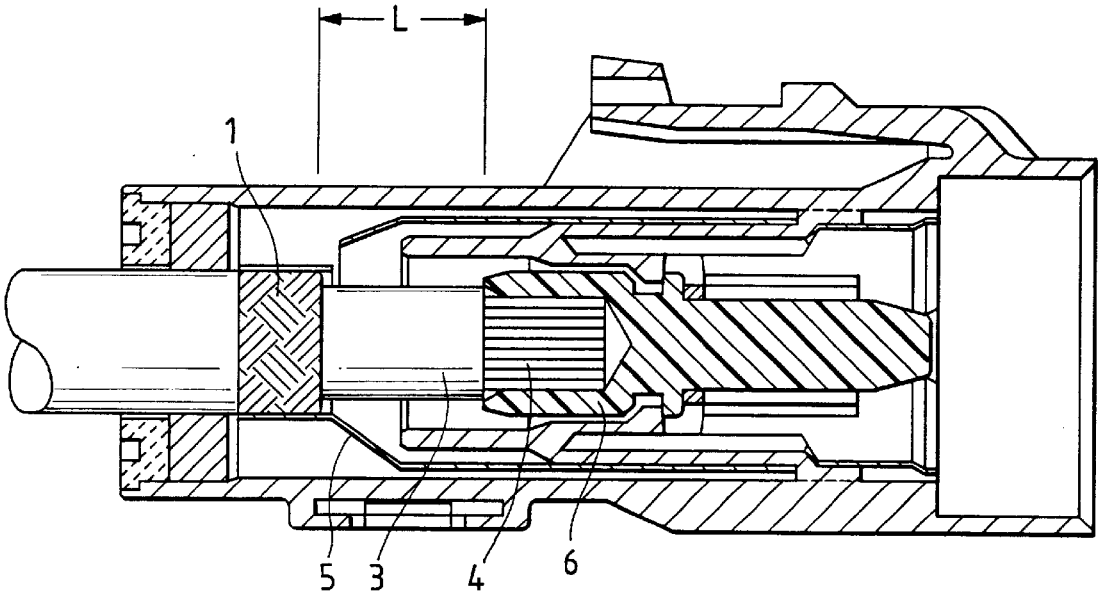
FIG. 2 PRIOR ART
FIG. 2 is a sectional view showing a conventional insulating structure for a shielded connector in which insulation is ensured by distancing members to be insulated from each other.
Figure 3:
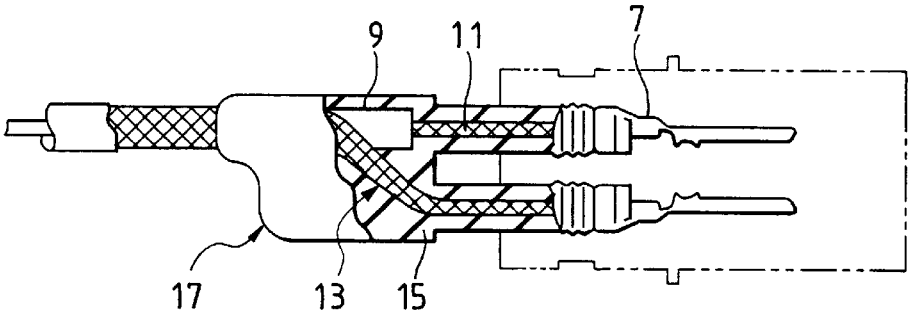
FIG. 3 PRIOR ART
FIG. 3 is a sectional view showing a conventional insulating structure for a shielded connector in which insulation is ensured by using a filling member.

FIG. 1 is a sectional view showing an insulating structure for a shielded connector of the invention.

A cylindrical outer housing 23 of a female connector 21 has a similarly cylindrical inner housing 27 integrally molded therewith. The inner housing 27 has a terminal accommodating chamber 25 therein. Between the outer housing 23 and the inner housing 27 is a shell insertion groove 29. The shell insertion groove 29 allows a cylindrical metallic shell 31 to be inserted thereinto.

A resilient retaining piece 33 is arranged in the terminal accommodating chamber 25 of the inner housing 27. The resilient retaining piece 33 can engage with a male terminal that will be described later. A small diameter portion 35 whose outer diameter is reduced is formed on the rear end of the inner housing 27. As a result of this construction, an insertion gap that allows a contact (described later) to be inserted is provided between the metallic shell 31 and the small diameter portion 35. It should be noted that the metallic shell 31 may be inserted into the shell insertion groove 29 after the housing has been molded or that the metallic shell 31 may be embedded in the housing through integral molding at the time the housing is molded.

On the other hand, a rod-like terminal 41 (male terminal 41) is pressured onto conductors 39*a* of an insulated core wire 39 of a shielded wire 37. The male terminal 41 has a flange portion 43 that is engageable with the resilient retaining piece 33 within the terminal accommodating chamber 25. The flange portion 43 comes in contact with a front wall 25*a* of the terminal accommodating chamber 25 and, at the same time, has the rear surface thereof retained by the resilient retaining piece 33 when the male terminal 41 is inserted into the terminal accommodating chamber 25. That is, the flange portion 43 is clamped by the front wall 25*a* and the resilient retaining piece 33 so that the attaching and detaching of the male terminal 41 is regulated.

The shielded wire 37 has an end portion of an outer sheath 45 cut away, and an exposed braid 47 is folded back toward the outer sheath 45. A cylindrical contact 49 is put over the folded-back braid 47. The contact 49 is pressured onto the braid 47 with the pressure portion on the rear thereof caulked. A cylindrical contact portion 51 with a larger diameter opening is formed in the front of the contact 49. The contact portion 51 is inserted into the insertion gap formed between the metallic shell 31 and the small diameter portion 35, so that the outer circumference of the contact portion 51 comes in intimate contact with the inner circumference of the metallic shell 31. That is, the braid 47 is electrically connected to the metallic shell 31 through the contact 49.

An insulator 53 is arranged around the outer circumference of the insulated core wire 39 between the contact 49 and the male terminal 41. The insulator 53 is made of an elastic material such as rubber (e.g., silicone rubber). The insulator 53 may either be formed into an O ring and inserted from the front of the connector and fitted over the outer circumference of the insulated core wire 39 before the male terminal 41 is pressured, or be formed into an annular body with a cut and fitted over the outer circumference of the insulated core wire 39 after the male terminal 41 has been pressured (cut type). Further, it is preferred that the insulator 53 not only have the inner circumference thereof brought into intimate contact with the outer circumference of the insulated core wire 39, but also have the outer circumference thereof brought into intimate contact with the inner circumference of the inner housing 27.

A watertight and dust-proof rubber stopper 55 is attached to the shielded wire 37 in the rear of the outer housing 23. The rubber stopper 55 is held within the outer housing 23 by a rear holder 57.

The thus constructed insulating structure for a shielded connector is assembled in the following way. The outer sheath 45 on the end portion of the shielded wire 37 is cut away, and the exposed braid 47 is folded back toward the outer sheath 45. The pressure portion of the contact 49 is caulked onto the folded braid 47. Then, after the insulator 53 has been fitted over the insulated core wire 39 of the shielded wire 37, the male terminal 41 is pressured and connected onto the conductors of the insulated core wire 39. It may be noted that the insulator 53 can be attached after the male terminal 41 has been pressured if the insulator 53 is of the cut type.

Then, the male terminal 41 with the shielded wire 37 pressured and connected thereto is inserted into the housing in which the metallic shell 31 has already been inserted into the shell insertion groove 29 and the contact portion 51 of the contact 49 is inserted into the insertion gap, so that the flange portion 43 is engaged with the resilient retaining piece 33.

As the last step, the rubber stopper 55 is located at a predetermined position within the outer housing 23, and the rear holder 57 for holding the rubber stopper is thereafter attached, so that the assembling operation is completed.

The thus assembled insulating structure has the following function. The insulator 53 is interposed between the male terminal 41 and the braid 47. That is, both members 41 and 47 are insulated, not by being distanced from each other, but by interposing an insulating member, i.e., the insulator 53, therebetween. This means that insulation between both members can be ensured with both members being away from each other by a small distance. Further, the insulator 53 can be arranged between the male terminal 41 and the braid 47 only by being fitted over the outer circumference of the insulated core wire 39. Which in turn simplifies the insulating structure manufacturing process compared with that involving the molding of the insulating structure.

According to the aforementioned insulating structure for a shielded connector, the braid 47 and the metallic shell 31 are insulated from the male terminal 41 not by distance but by interposing the insulator 53 therebetween. As a result, the distance between both members can be reduced, which contributes to not increasing the size of the connector. Further, this structure can be implemented only by attaching the insulator 53 to the shielded wire 37. Therefore, the connector can be fabricated with ease without involving such a complicated process as molding using a filling member.

While the female connector 21 has been taken as an example in the aforementioned embodiment, it goes without saying that the insulating structure of the invention can provide similar advantages by using a similarly designed insulator 53 when applied to a male connector.

Further, while the case where the braid 47 is connected to the metallic shell 31 through the contact 49 has been taken as an example in the aforementioned embodiment, the insulating structure of the invention is, of course, applicable to a connector of such structure that the braid 47 is directly connected to the metallic shell 31.

Still further, in addition to the type that is inserted into the inner circumference of the inner housing 27, the insulator 53 may also be of the type that comes in contact with the rear opening end face of the inner housing 27 to close the rear end opening of the inner housing 27 while fitted over the outer circumference of the insulated core wire 39 (this structure is not shown in the drawings). In this case, a stepped portion including a small diameter portion and a large diameter portion may be arranged on the outer circumference of the insulator 53, so that the stepped portion can come in contact with the rear opening end face of the inner housing 27 with the small diameter portion inserted into the inner circumference of the inner housing 27.

As described in the foregoing, the insulating structure for a shielded connector of the invention is characterized as arranging an insulator to insulate the braid and the metallic shell from the terminal, not as distancing the former from the latter. Therefore, the distance between the former and the latter can be reduced, which in turn contributes to ensuring insulation without making the size of the connector larger than necessary. Further, this insulating structure is prepared only by fitting the insulator over the shielded wire. Therefore, the process of molding using a filling member can be dispensed with, which in turn contributes to implementing easy production. As a result, insulation, downsizing, easy production can be achieved simultaneously.

What we claim is:

1. An insulating structure for a shielded connector having a terminal connected to a conductor of an insulated core wire, and further having the terminal inserted within a terminal accommodating chamber of a housing and having a shielding braid surrounding the insulated core wire, said shielding braid being folded back from said insulated core wire by a predetermined length, and electrically connected to a metallic shell inserted within said housing and covering the terminal accommodating chamber, wherein a single annular insulator fits over an outer circumference of the insulated core wire between the terminal and the shielding braid; and wherein said insulator has a width in an axial direction which is smaller than said predetermined length.

2. The insulating structure according to claim 1, wherein the insulator is made of an elastic material, and has an inner circumference thereof brought into intimate contact with an outer circumference of the insulated core wire and has an outer circumference thereof brought into intimate contact with an inner circumference of the terminal accommodating chamber.

3. The insulating structure according to claim 1, wherein said annular insulator comprises an O-ring.

4. The insulating structure according to claim 1, wherein said terminal accommodating chamber has an insertion groove wherein said metallic shell is inserted.

5. The insulating structure according to claim 3, wherein said metallic shell electrically connects to said shielding braid by a cylindrically shaped connector having a back portion caulked to said shielding braid covering and a front portion inserted in said insertion groove wherein said front and back portion are viewed in a terminal inserting direction.

* * * * *